US006486107B1

(12) United States Patent
Khantzis

(10) Patent No.: US 6,486,107 B1
(45) Date of Patent: Nov. 26, 2002

(54) APPARATUS FOR AND METHOD OF PRODUCING LIQUID TO CLEAN AND COAT SURFACES

(76) Inventor: Carlos A. Khantzis, 4737 Galendo St., Woodland Hills, CA (US) 91364

( * ) Notice: Subject to any disclaimer, the term of this patent is extended or adjusted under 35 U.S.C. 154(b) by 0 days.

(21) Appl. No.: 10/175,091

(22) Filed: Jun. 18, 2002

(51) Int. Cl.[7] ..... C11D 9/36; C11D 1/72

(52) U.S. Cl. ..... 510/163; 510/112; 510/115; 510/119; 510/122; 510/180; 510/243; 510/421; 510/466

(58) Field of Search ..... 510/112, 115, 510/119, 122, 163, 180, 243, 421, 466

(56) References Cited

U.S. PATENT DOCUMENTS 4,842,850 A * 6/1989 Vu ..... 424/70

* cited by examiner

*Primary Examiner*—Charles Boyer

(74) *Attorney, Agent, or Firm*—Thomas I. Rozsa; Tony D. Chen

(57) ABSTRACT

The present invention is a liquid protectant which protects and extends the life of anti-reflective, hydrophobic (water repellent) and mirror coatings and all types of plastic lenses from scratches, abrasions and "wear-off" of the coatings by upgrading the performance of cleaning liquids and provides the highest level of protection against abrasion as well as optical clarity, ease of cleaning and anti-static properties. The present invention apparatus and method of producing the same is used to both clean and coat all types of optical lenses which includes a coating in the nature of an optical lens coating which bonds to the exterior surface of an anti-reflective coated optical lens to create a barrier between the anti-reflective coating and the cleaning surfaces.

10 Claims, No Drawings

APPARATUS FOR AND METHOD OF PRODUCING LIQUID TO CLEAN AND COAT SURFACES

BACKGROUND OF THE INVENTION

1. Field of the Invention

The present invention relates to the field of cleaning solutions and coating solutions which are used to both clean and coat optical lenses.

2. Description of the Prior Art

In general, lenses incur the greatest surface damage, abrasion and the "wear-off" or cracking and peeling of the anti-reflective and hydrophobic and mirror coatings during the cleaning process. This is due to the fact that most lense cleaning formulations available on the market today are still made of simple formulas comprised of diluted solutions of surfactants in water and alcohol. An anti-reflective coated lense cleaned with a regular alcohol based cleaner will end up with a "squeaky" clean surface that ultimately is worn off by the friction generated through the rubbing process. In addition, static build-up generated by the friction will have a magnetic attraction effect on new dust particles contributing to future abrasion.

Therefore, there is a significant need for an improved solution which both cleans and covers and protects the anti-reflective and hydrophobic (water repellent) and mirror coating in all types of lenses with added anti-static properties.

SUMMARY OF THE INVENTION

The present invention is a liquid protectant which protects and extends the life of anti-reflective, hydrophobic (water repellent) and mirror coatings and all types of plastic lenses from scratches, abrasions and "wear-off" of the coatings by upgrading the performance of cleaning liquids and provides the highest level of protection against abrasion as well as optical clarity, case of cleaning and anti-static properties.

The present invention apparatus and method of producing the same is used to both clean and coat all types of optical lenses which includes a coating in the nature of an optical lense coating which bonds to the exterior surface of an anti-reflective coated optical lense to create a barrier between the anti-reflective coating and the cleaning surfaces.

Further, the present invention is an optical lense cleaning preparation for use with eyeglasses, sunglasses, camera lenses, computer screens and cd roms.

It has been discovered, according to the present invention, that by combining a combination of novel chemicals, as will be discussed hereafter, the present invention creates a protective cleaning and coating surface which will stand up to the most rigorous testing.

For use of the present invention, it has been discovered that by adding chemicals which are improvements over the standard alcohol based cleaner, significant properties to both protect and clean lenses are achieved.

It has been discovered that a combination of deionized water to function as a solvent, polydimethylsiloxane (of low viscosity) which functions as a gloss and water repellant, ethoxylated fatty alcohol which functions as a surfactant, mixed parabens and sodium parabens which functions as a preservative, and silica which functions as a thickener and to reduce abrasiveness, combines to create a very novel and improved solution which can be used to clean and thereafter temporarily coat anti-reflective, hydrophobic and mirror coatings on all types of lenses which are used with eyeglasses, sunglasses, camera lenses, computer screens, and cd roms.

It is therefore an object of the present invention to create a new and improved liquid cleaning preparation which will also serve to coat lenses so that lenses retain their anti-reflective, hydrophobic, and mirror image coatings while being cleaned and at the same time coated with a protectant to enhance the life of the optical features of the lens.

It is a further object of the present invention to avoid the problems associated with prior art cleaning formulas comprised of diluted solutions of surfactants in water and alcohol so that lenses will be cleaned in a safe manner without scratching and without creating abrasions or opportunity for dust to attach onto the lens.

Further novel features and other objects of the present invention will become apparent from the following detailed description, discussion and the appended claims.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention liquid apparatus is a dilute emulsion of polysiloxane and water, preserved with mixed parabens and sodium parabens. It has a pH of approximately 4.7. The following sets forth the ingredients, the function of the ingredients and the weight factor utilized with the present invention novel liquid cleaning and protectant solution:

CHART 1

| INGREDIENTS | FUNCTION | WEIGHT FACTOR |
|---|---|---|
| Deionized Water | Solvent | 99.35 |
| Polydimethylsiloxane (low viscosity) | Gloss, water repellant | 0.56 |
| Ethoxylated fatty alcohol | Surfactant | 0.024 |
| Mixed parabens and sodium parabens | Preservative | 0.062 |
| Silica | Thickener, abrasive | 0.004 |

The above-referenced preferred embodiment to the present invention creates the optimal effect as discussed above. However, it will be appreciated, that the percentages as set forth above although describing the preferred embodiment, in fact can be modified to within ranges of 10 to 20% plus or minus of any of the percentages and still have an effective combination of chemicals to create the desired results.

The method of producing the liquid cleaning and protecting solution is as follows:

Step 1

A blending tank is first steam cleaned, then deionized water washed before adding the ingredients. After this is accomplished, Step 2 is to carefully weigh the deionized water into the blend tank in the percentages by weight factor as discussed above. After this has been accomplished, Step 3 is to add a blended silicone emulsion of polydimethylsiloxane, ethoxylated fatty alcohol, mixed parabens, sodium parabens and silica to the blend tank with gentle agitation. The blending process takes place for approximately 20 minutes. Thereafter, Step 4 is for a sample in a dedicated glassware in taken to a lab for quality control testing.

Therefore, through the combination of the above ingredients which serve the functions as set forth above in the weight factors as set forth above and combined in the methodology as discussed above, there is created a very novel and unique cleaning and coating liquid for lenses including lenses used with eyeglasses, sunglasses, camera lenses, computer screens and cd roms.

The above-referenced invention was extensively tested to verify the optical properties and cleaning and coating properties as discussed above. By way of example, a severe abrasive comparative test was conducted by a leading laboratory to determine the degree that the cleaner has allowed a cloth to damage the anti-reflective coating lens surface. On a scale of 0 to 5, with 0 being heavy abrasion and 5 being no abrasion at all, the present invention scored a 3.2 average and a competitive leading product on the marketplace today scored a 2.0 average.

The dry cloth lifetime test is a rough/abrasion test which causes lifetime wear on the anti-reflective and hydrophobic coated lenses. This is accomplished by operating a wiping action with an anti-reflective micro filament core that follows the curve of the lens 2000 times and includes the application of the liquid cleaner every 50 cycles and a new dry cloth every alternate 50 cycles to the completion of the 2,000 cycle test. To achieve statistical significant difference, this test is conducted on ten separate lenses (T1 to T10). To yield a comparison, the test was completed a second time on anti-reflective coated lenses with a competitive cleaner. Lenses are checked for amount of abrasion at the end of the test to determine if there was a significant increase in damage. The actual number of scratches are counted and in cases where there are too many scratches to count accurately, a haze measurement is used instead.

It is most important to note that while the present invention liquid scored an average of 3.2, it scored 4.0 on the first test lens and 4.0 again through the next four with an average of 4.0 for the first five lenses. The alcohol based competitive liquid by comparison scored 1 (heavy abrasion damage) on the first test and a range of 1 to 3 for the next four tests for an average of 2.2 for the first five lenses and never achieved a score of 4.0 as the present invention did.

The above test results provide laboratory validation that the application and use of the present invention liquid on plastic and anti-reflective and hydrophobic lenses will extend the life of a plastic and coated lens, minimizing costly returns, exchanges, and customer dissatisfaction due to scratches and or damage to the coatings or lens surface. In addition to the dry cloth lifetime test, the following additional tests further were conducted to support the properties of the present invention as claimed.

For an anti-static test, two anti-reflective coated lenses were washed and then dry rubbed for a specific length of time. On half of the lenses, the present invention liquid solution was applied directly after the wash and prior to the dry rub. Anti-static properties are very important to a cleaning solution because they prevent dust particles from becoming attached to the lens surface. Since lenses are usually not rinsed prior to cleaning, wet or dry cleaning of a lens surface containing dust particles will contribute to future abrasion as dust particles are rubbed against the surface in the cleaning process.

The relative anti-static property of lenses treated with the present invention solution was a low 3.55 and for those lenses that were not treated the relative anti-static property was 6.38 for a significantly higher amount of static electricity than the treated lenses. The present invention reduced static electricity by almost half.

There was also performed an oily cleaning test. In this test the specific amount of specified standard oil is deposited on the surface of an anti-reflective coated lens. An optical test is then conducted to determine the percent of haze in a lens that may cause a decrease in visibility to the wearer and measured after 20, 40 and 60 cycles of mechanical rubbing with a cleaning cloth impregnated with the liquid cleaners to replicate the typical action seen in normal use. The difference of the initial haze and the final haze will indicate the amount of oil left on the lens surface. Two separate tests were conducted testing the present invention liquid and competitive alcohol based cleaners.

In the results of the oily cleaning test, the lenses used with the present invention solution were 0.02% haze and results of the competitive cleaner were 0.08% haze. It is important to note that while the test results are based on 60 cycles of rubbing and cleaning, 20 cycles of mechanical rubbing replicate the typical action seen in normal use. The results for 20 cycles for the present invention liquid were 0.11% haze while the competing liquid scored 2.62% haze.

The anti-reflective cleaner soak test is a test to determine if the cleaner will damage the anti-reflective coating over time through crazing or delimitation of the anti-reflective coating. This is a 120 hour test and during this test, anti-reflective lenses are inspected for damage. The results showed no damage occurred following 120 hours of testing when the present invention liquid was used. On a scale of 1 to 5 with 5 being no damage whatsoever, all scores for the present invention liquid ranked at 5.

The reduction of reflections is the main purpose of an anti-reflective coating and as a consequence transmittance is enhanced. The reflectance test uses a spectrophotometer to accurately measure the anti-reflective characteristics of a lens with an anti-reflective coating. In results of this test, the present invention liquid improved the reduction of reflections slightly and thereby it improves the performance of the anti-reflective coating and its intended use. An improvement in the reflectance properties of an anti-reflective coated lens produces optimum viewing by reducing the coherence of reflected images while maintaining the exceptional resolution.

Through use of the present invention liquid solution to be used as a cleaning and coating agent as discussed above, it has been shown that the present invention applies a protective coating over the lens during the cleaning process to reduce surface abrasion and provide the following beneficial results:

1. Upgraded performance technology of cleaning features;
2. Anti-reflective safe;
3. Anti-scratch and anti-abrasion resistance;
4. It extended the life of the anti-reflective and hydrophonic and mirror coated lenses;
5. It provided ultimate protection against abrasion in the lens cleaner category;
6. It provided anti-static and anti-soiling;
7. It produced ease of cleaning, and
8. It reduced the coherence of reflected images (reflectivity) while improving optical clarity.

Therefore, the present invention very substantially improved the life of lenses. The present invention cleans, covers and protects the anti-reflective and hydrophobic (water-repellent) and mirror coatings in all types of lenses with added anti-static properties.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description in not intended in any way to limit the broad features or principles of the present invention, or the scope of the patent to be granted. Therefore, the invention is to be limited only by the scope of the appended claims.

What is claimed is:

1. A liquid for cleaning and coating an optical lens consisting of:

a. 99.35% deionized water functioning as a solvent;

b. 0.56% polydimethylsiloxane of low viscosity functioning as a gloss and water repellant;

c. 0.024% ethoxylated fatty alcohol functioning as a surfactant;

d. 0.062% mixed parabens and sodium parabens functioning as a preservative; and e. 0.004% silica functioning as a thickener and to reduce abrasion.

2. A liquid for cleaning and coating an object, comprising:

a. approximately 99.35% deionized water;

b. approximately 0.56% polydimethylsiloxane of low viscosity;

c. approximately 0.024% ethoxylated fatty alcohol;

d. approximately 0.062% mixed parabens and sodium parabens; and e. approximately 0.004% silica.

3. A liquid for extending the life of anti-reflective, hydrophobic and mirror coatings on surfaces consisting of:

a. 99.35% deionized water functioning as a solvent;

b. 0.56% polydimethylsiloxane of low viscosity functioning as a gloss and water repellant;

c. 0.024% ethoxylated fatty alcohol functioning as a surfactant;

d. 0.062% mixed parabens and sodium parabens functioning as a preservative; and e. 0.004% silica functioning as a thickener and to reduce abrasion.

4. A liquid for extending the life of anti-reflective, hydrophobic and mirror coatings on surfaces comprising:

a. approximately 99.35% deionized water;

b. approximately 0.56% polydimethylsiloxane of low viscosity;

c. approximately 0.024% ethoxylated fatty alcohol;

d. approximately 0.062% mixed parabens and sodium parabens; and e. approximately 0.004% silica.

5. A process for a preparation of a liquid for extending the life of anti-reflective, hydrophobic and mirror coatings on surfaces comprising:

a. steam cleaning a blending tank, and deionized water washing the blending tank before adding ingredients;

b. adding approximately 99.35% by weight deionized water to function as a solvent;

c. blending approximately 0.56% by weight polydimethylsiloxane of low viscosity to function as gloss and a water repellant with 0.024% by weight ethoxylated fatty alcohol to act as a surfactant and adding to the deionized water;

d. adding approximately 0.062% by weight mixed parabens and sodium parabens to function as a preservative;

e. adding approximately 0.004% by weight silica to function as a thickener and to reduce abrasion;

f. blending all of the above items (a) through (e) with gentle agitation.

6. The method as defined in claim 5 wherein said blending of elements (a) through (e) is blended with gentle agitation for approximately 20 minutes.

7. The method as defined in claim 5 further comprising the step of applying said blended liquid to the surface to be cleaned and coated.

8. A method for a preparation of a liquid for extending the life of anti-reflective, hydrophobic and mirror coatings on surfaces consisting of:

a. steam cleaning a blending tank, and deionized water washing the blending tank before adding ingredients;

b. adding 99.35% by weight deionized water to function as a solvent;

c. blending 0.56% by weight polydimethylsiloxane of low viscosity to function as gloss and a water repellant with 0.024% by weight ethoxylated fatty alcohol to act as a surfactant and adding to the deionized water;

d. adding 0.062% by weight mixed parabens and sodium parabens to function as a preservative;

e. adding 0.004% by weight silica to function as a thickener and to reduce abrasion;

f. blending all of the above items (a) through (e) with gentle agitation.

9. The method as defined in claim 8 wherein said blending of elements (a) through (e) is blended with gentle agitation for approximately 20 minutes.

10. The method as defined in claim 8 further comprising the step of applying said blended liquid to the surfaces to be cleaned and coated.

* * * * *